US005767795A

United States Patent [19]

Schaphorst

[11] Patent Number: 5,767,795

[45] Date of Patent: Jun. 16, 1998

[54] GPS-BASED INFORMATION SYSTEM FOR VEHICLES

[75] Inventor: Richard A. Schaphorst, Jenkintown, Pa.

[73] Assignee: Delta Information Systems, Inc., Horsham, Pa.

[21] Appl. No.: 675,006

[22] Filed: Jul. 3, 1996

[51] Int. Cl.[6] ..... G08G 1/123

[52] U.S. Cl. ..... 340/988; 340/990; 340/995; 701/200; 701/201; 701/206; 701/213

[58] Field of Search ..... 340/995, 990, 340/988; 364/448, 449.5, 449.7, 443, 441.1; 701/200, 213, 206, 201

[56] References Cited

U.S. PATENT DOCUMENTS

| | | | |
|---|---|---|---|
| 4,974,170 | 11/1990 | Bouve et al. | 364/518 |
| 5,229,947 | 7/1993 | Ross et al. | 364/443 |
| 5,519,392 | 5/1996 | Oder et al. | 340/995 |
| 5,537,324 | 7/1996 | Nimura et al. | 364/449.2 |
| 5,559,707 | 9/1996 | DeLorme et al. | 701/200 |
| 5,614,898 | 3/1997 | Kamiya et al. | 340/995 |
| 5,617,319 | 4/1997 | Arakawa et al. | 364/449.1 |

*Primary Examiner*—Jeffery A. Hofsass
*Assistant Examiner*—Benjamin C. Lee
*Attorney, Agent, or Firm*—William H. Eilberg

[57] ABSTRACT

An electronic tour guide overcomes the monotony of an automobile trip. The system includes a GPS receiver, a computer, and a database of pre-recorded information. These components may be contained in one housing, and may be permanently installed in a vehicle. The database contains information pertaining to various geographical regions. The computer receives a signal from the GPS indicating the position of the vehicle. The computer then retrieves information from the database, the retrieved information corresponding to the position determined by the GPS receiver. The information is presented to the traveler, either on a video display or through an audio playback unit. The system can therefore provide information on the history, geography, and/or culture, relating to the region through which the vehicle is traveling. The information can be modified to include specific reference to points of interest with respect to the instantaneous position and orientation of the vehicle.

8 Claims, 1 Drawing Sheet

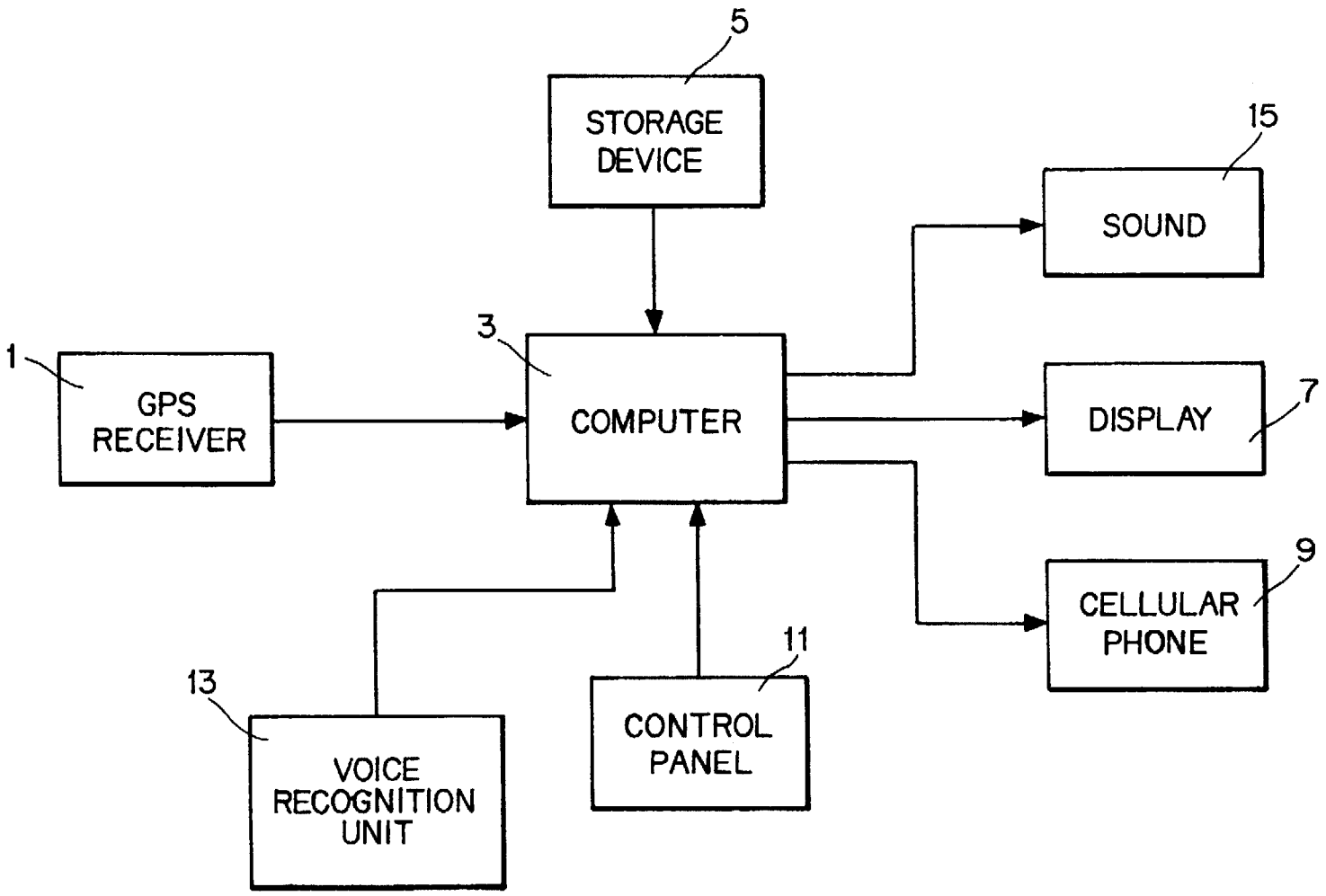
15
SOUND
7
DISPLAY
9
CELLULAR PHONE
5
STORAGE DEVICE
COMPUTER
3
11
CONTROL PANEL
VOICE RECOGNITION UNIT
13
GPS RECEIVER
1

GPS-BASED INFORMATION SYSTEM FOR VEHICLES

BACKGROUND OF THE INVENTION

This invention relates to the field of information storage and retrieval, and includes a system which efficiently retrieves information for use by the operator of a vehicle or by other travelers.

One purpose of the present invention is to provide information to travelers. The invention is especially useful in automobiles, and can be used as an electronic tour guide for the occupants of an automobile. The invention is not limited to the field of automobile travel, however. For example, it can also be used by pedestrians or hikers.

Traveling by automobile can become unpleasant, especially when the distance to be covered is great. An automobile trip can be monotonous, and often the scenery immediately outside the vehicle is not particularly attractive. Road maps give general information about the highways in a region, but provide little information about the history, geography, and other background of the area. A traveler passing through an unfamiliar location will have little idea about restaurants, hotels, motels, and other tourist facilities in the vicinity. Often the only information available to the traveler comes from a few billboards placed along the highway. Some travelers carry guide books for a region, but guidebooks generally do not describe all the facilities in an area, and also do not provide immediate help for the newcomer in finding various attractions.

The present invention solves the above-described problems by providing a compact information storage and retrieval unit which can function as an electronic tour guide. The system of the present invention uses the Global Positioning System (GPS), which is a satellite-based navigation system. The present invention combines GPS technology with known information storage techniques, to provide an information system that can be conveniently and permanently mounted in the dashboard of a vehicle, or carried in the vehicle by the traveler, or carried by a pedestrian or hiker.

SUMMARY OF THE INVENTION

The system of the present invention includes a GPS receiver, an information storage and retrieval device, such as a CD-ROM player, and a programmed computer means connected both to the GPS receiver and to the CD-ROM player. The system is preferably carried in a vehicle, either as an independent unit or as a component which is installed permanently in the vehicle. The GPS receiver determines the instantaneous geographical position of the vehicle, and transmits this information to the computer. The items of information stored on the CD-ROM (or other mass storage device) are grouped according to geographic region. The computer is programmed to access the information from the CD-ROM, which information corresponds to the current position as determined by the GPS receiver.

In one embodiment, the computer is programmed to operate the CD-ROM player so as to download information on the history, geography, and culture associated with the region through which the vehicle is passing. The output can be played through an audio unit, such as a sound board, or through the radio mounted in the vehicle, or it can be presented by other means, such as through a video display. The computer can simply replay the information stored on the CD-ROM, pertaining to the current location. Or the computer can be programmed to add to the stored information, before presenting the information to the user, by including comments about the specific location of a point of interest, taking into account the exact location and orientation of the vehicle.

In another embodiment, the computer is programmed to retrieve information about hotels, motels, restaurants, and other tourist facilities, located within the region near the vehicle, according to commands entered by a user. The computer can add to this information so as to give the traveler specific directions based on the current position of the vehicle. The computer can also define an interface which enables the user to search the CD-ROM interactively.

In another embodiment, the computer is programmed to dial a cellular telephone, to make a reservation at a restaurant or other facility which has been by the user.

The invention therefore has the object of providing an information storage and retrieval system for use by a traveler.

The invention has the further object of relieving the monotony of automobile travel by providing an easy means of obtaining historical, geographical, and cultural information on a region through which the automobile is traveling.

The invention has the further object of providing information of interest to automobile travelers, such information being pertinent to the current location of the automobile.

The invention has the further object of reducing or eliminating the need for road maps and/or guide books.

The invention has the further object of providing a method for retrieving information relating to a particular geographic region.

The invention has the further object of providing an electronic tour guide for travelers.

The reader skilled in the art will recognize other objects and advantages of the present invention, from a reading of the following brief description of the drawings, the detailed description of the invention, and the appended claims.

BRIEF DESCRIPTION OF THE DRAWING

The FIGURE provides a block diagram of the components of the system of the present invention.

DETAILED DESCRIPTION OF THE INVENTION

The FIGURE shows the major components of the system of the present invention. Global Positioning System (GPS) receiver 1 is connected to computer 3, which is connected to storage device 5. Computer 3 may be any programmable device capable of performing the functions stated below. For example, computer 3 could be a microprocessor chip, or its equivalent, or it could be a larger computer. The computer accepts signals from GPS receiver 1, and is capable of receiving input from storage device 5, and of generating signals which control storage device 5. In the preferred embodiment, the storage device includes a CD-ROM and a CD-ROM player, but other mass-storage devices, such as a magnetic tape and a tape drive, or a magnetic disk, or other equivalent devices, could be used instead.

The GPS receiver detects signals from overhead satellites, and uses the differences in arrival times of these signals to determine the position of the receiver with remarkable accuracy. The technology of GPS is well-known; the GPS receiver itself does not form part of this invention.

Similarly, the CD-ROM and CD-ROM player, or other mass storage device, are made using known technology, and also do not, taken by themselves, form part of the present invention.

The computer may be connected to provide outputs to display 7, and/or to cellular telephone 9, and/or to audio unit 15. The computer may be connected to receive inputs from control panel 11 and/or from voice recognition unit 13.

The audio unit 15 can be a sound board, which is commercially available, or it could include the radio that is mounted in the vehicle.

Not all of the components shown in the FIGURE need be present in every embodiment. For example, the invention may be practiced without voice recognition, or without a control panel, or even without any control other than an on-off switch. Similarly, any one or more of the cellular telephone, the display, and/or the audio unit could be omitted, as long as the computer has at least one means of providing output to the user. The essential elements of the system include the GPS receiver, some kind of computing device, an information storage means, at least one control means, and at least one means for providing output to a user. But the control means could be as simple as an on-off switch for the entire unit.

Also, the functions of some of the various blocks can be combined in the same physical unit. For example, the computer, the display, and the control panel could all be provided in one compact housing. Compactness is especially important when the unit is used by pedestrians or hikers. All such combinations of elements are within the scope of the invention. The blocks of the FIGURE are shown separately for purposes of clarity, but are not meant to imply that the components are necessarily housed in separate boxes.

In one embodiment, the system operates as follows. The GPS receiver, which includes a suitable antenna (not shown) for receiving GPS signals from overhead satellites, generates a signal indicative of the position of the vehicle in which the system is installed or carried. This signal comprises an input to computer 3. The GPS receiver may generate the signal in analog form, in which case the computer includes analog-to-digital conversion means, or the GPS receiver may include its own means for generating a digital signal indicative of present position, which signal is directly usable by the computer.

The computer receives the signal which indicates position, and determines in what area the vehicle is located. The computer can be programmed, for example, to divide the country into a plurality of geographic regions. These regions can be small and numerous, or large but few in number. Through simple programming, the computer can determine, from the signal received from the GPS receiver, in which region the vehicle is located.

There are many ways to relate a GPS signal to a region of the country, and the invention is not limited to a particular method. One method is described in the following paragraphs.

In one method, the system provides a stored table, in the permanent memory of the computer, which contains a series of combinations of latitude and longitude. That is, the table contains a list of pairs of numbers, each pair comprising a latitude and a longitude. Every possible latitude and longitude combination (for the country) would be presented in the table, with a predetermined level of precision (e.g. to the nearest degree, to the nearest minute, or to the nearest second). Associated with each latitude and longitude combination is another number which represents the region in which that combination belongs. Thus, the stored table would include, in effect, a list of ordered triplets of numbers, the triplets comprising the latitude, the longitude, and the associated region. The third number would be assigned according to a predetermined assignment of numbers to regions of the country. All of these numbers would be stored in the permanent memory of the computer.

The computer would obtain a signal from the GPS receiver in the form of a latitude and longitude combination. The computer would then enter the table, locate this latitude and longitude combination, and then retrieve the number associated with that combination. The latter number represents the region in which the GPS receiver is located.

The CD-ROM, or other mass storage unit, is provided with pre-recorded information arranged according to geographic region. In particular, the data on the CD-ROM is arranged in sectors, and each sector (or each group of sectors) corresponds to a number. The number identifying a sector can therefore correspond to the number identifying a geographic region. The computer activates storage device 5 to download information, from the appropriate sector(s) of the CD-ROM, which information pertains to the region determined from the table. The latter information is then played, at the command of the computer, through an appropriate output device, such as through audio unit 15.

In a more specific example of the operation of the present invention, the information stored in storage device 5 includes historical and cultural information pertaining to each region for which information is available. As the vehicle passes from one region to another, the computer generates an audible narrative, through audio unit 15, which relates the information to the occupant(s) of the vehicle. The information downloaded from storage device 5 is temporarily stored within a memory unit forming part of the computer. The latter memory unit comprises a buffer for storing incoming data from storage device 5 before it is ready to be played through audio unit 15. The latter feature is especially important when the vehicle is crossing a boundary between regions, and the system has not yet finished playing the information pertaining to the earlier region.

In the examples given above, the system of the present invention comprises an electronic tour guide. The GPS receiver insures that the system always knows the location of the vehicle, so the system can provide a narrative pertaining to that region. The level of detail of the narrative is limited only by the capacity of the storage device and the processing and storage capability of the computer.

In one embodiment, the computer is programmed to deliver a fixed narrative associated with each particular location. But in other embodiments, the computer may alter the stored narrative to include comments on location of an attraction relative to the current position of the vehicle.

In a further example, the storage device may contain very detailed information about a region (and the region covered may be correspondingly small, so that all possible information can fit on a CD-ROM). For example, a single CD-ROM might be used for traveling in only one state, or through a small region of that state. In this case, the stored information can include very detailed information about historical sites, geographic features, and other points of interest, together with their positions relative to various roads. The system can therefore be programmed to provide information to the occupants of the vehicle with respect to a particular direction. For example, the occupants might hear a narrative which begins, "On your right you can see the Gettysburg battlefield etc." The system can be programmed to calculate a direction and/or distance, and to synthesize a narrative which combines the latter information, which is variable, with the pre-recorded information retrieved from the CD-ROM, concerning the site or point of interest.

In the examples given above, it was assumed that the content of the narrative is fixed, except possibly for details about the direction (e.g. left or right) of a particular point of interest. But it is also possible for the occupants of the vehicle to control the content of the narrative in advance, by telling the system what types of information to emphasize. For example, the user may want only information about nearby mountains, or information about national parks and monuments. The system can provide a menu, on display 7, or using the audio unit 15, which menu lists various available subject areas. The user can then press the appropriate keys on control panel 11, or choose an item using the voice recognition unit 13, so as to select a particular item. The computer receives the selection and prepares the narrative accordingly.

All of the functions described in this specification can be performed with voice recognition unit 13 instead of a control panel. That is, the user can specify the desired subject area orally, possibly in response to an audible prompt from audio unit 15.

Another use of the present invention comprises providing information on restaurants and other tourist accommodations to the occupants of the vehicle. For example, suppose that the occupants of the vehicle want information about local restaurants. The occupants select "restaurants" from a menu on display 7, or by use of the voice recognition unit. The system is programmed to display (or provide in audio form) various categories of restaurants (such as "Italian", "Chinese", etc.). When the user selects a category, the system proceeds to provide information about each restaurant stored in the storage device 5, pertaining to the immediate region in which the vehicle is located. When the user then selects a particular restaurant, the system responds by providing directions to the restaurant. The directions are synthesized according to the position of the vehicle, relative to the geographical information stored in the computer. For example, the system can be sufficiently specific to be able to advise the driver to "turn right at the next exit, proceed three miles, and turn left, etc."

In general, all of the specifications provided by the user to the system could be provided in response to a series of hierarchical prompts. For example, following a request for restaurant information, the system could ask for a preference of food type, and then could ask for a preference for price range, etc.

In another embodiment, the computer can be programmed such that, when the user selects a restaurant, the computer activates cellular telephone 9, and dials the number of the chosen restaurant, the number being included in the information stored on the CD-ROM.

In an important aspect of the present invention, the computer is programmed to compute the speed and direction of movement of the vehicle (or traveler), based on a series of locations determined by the GPS receiver, and hence keeps track of the actual location of the vehicle. Based on this computed information, the computer is programmed to organize its memory access structure continuously, in anticipation of a request from the user for information. Thus, when the user asks for information, the computer need not spend much time searching and formatting of information, but can instead immediately provide the user with all information pertaining to the location.

A further application of the invention resides in providing a traveler with information when on major expressways and turnpikes. Information could be stored regarding the facilities available at or near specific exits of a highway.

In one preferred embodiment, the system is built into the dashboard of a vehicle. The system could be provided in a single housing which fits into a suitable receptacle in the dashboard. The housing would include the GPS receiver, the computer, the CD-ROM drive, and some or all of the other peripheral equipment symbolized in the FIGURE.

Alternatively, the system can be provided independently of the vehicle. For example, the system could again be provided in a single housing, but this housing would be self-contained and separate from the vehicle. A traveler could then carry the system in a vehicle, but could also take the system with him or her when leaving the vehicle. Thus, the present invention can also be used by pedestrians or hikers.

The computer can include software which enables the CD-ROM to be queried interactively by the user, so that the user can obtain selected information from the CD-ROM, pertaining to the position of the vehicle. Software for obtaining information from a CD-ROM is well-known in the art.

In a very simple but convenient embodiment, the system includes only GPS receiver 1, computer 3, storage device 5, and audio unit 15. When the system is turned on, the computer automatically plays, through the audio unit, a narrative corresponding to the region in which the system is located, as determined by the GPS receiver. In this embodiment, the only control is the on-off switch for the entire unit. The latter embodiment is especially useful for persons traveling alone, when it would be dangerous to operate controls, or watch a visual display, while driving.

The invention can be modified in other ways. Additional categories of information can be stored on the CD-ROM and accessed by the user in a manner similar to that described above. Various schemes for interactively obtaining information from the database stored on the CD-ROM (or other mass storage device) can be used. Other means of providing output, such as a printer, could be used in addition to, or instead of, the means shown in the FIGURE.

As noted above, there are other ways by which the computer can determine the region in which it is located, based on the input from the GPS receiver. For example, instead of having the numerical table described above, the memory of the computer may contain a detailed symbolic map, and the coordinates specified by the GPS receiver can be electronically placed on that map.

These and other modifications, which will be apparent to those skilled in the art, should be considered within the spirit and scope of the following claims.

What is claimed is:

1. An information retrieval system for use by a mobile traveler, the system comprising:

a) means for determining a location of the traveler by reception and analysis of signals from overhead satellites, b) means for storing information relating to a plurality of geographical locations, and means for retrieving said information, c) the information storing and retrieving means being operatively connected to the location determining means, wherein the information storing and retrieving means comprises means for retrieving information on a geographical location in a vicinity of the traveler, and wherein the information storing and retrieving means includes a database which contains information on facilities at or near exits of major highways, the system further comprising means for determining a nearest exit and for providing information concerning facilities near said nearest exit.

2. A method of providing information to a traveler, the method comprising the steps of:

a) determining a position of the traveler by receiving and analyzing GPS signals, b) retrieving information from a database, wherein the retrieved information corresponds to the position determined in step (a), and c) presenting the retrieved information to the traveler, wherein the database contains information on facilities at or near exits of major highways, and wherein the method further comprises the steps of determining a nearest exit and providing information to the user concerning facilities near said nearest exit.

3. The method of claim 2, wherein the presenting step is preceded by the step of generating additional information derived from the position determined in step (a), and wherein the presenting step comprises presenting the retrieved information and the additional information to the traveler.

4. The method of claim 2, wherein the presenting step is selected from the group consisting of displaying the retrieved information on a video display and playing the information to the traveler in audio form through an audio unit.

5. The method of claim 2, wherein the information contained in the database includes information selected from the group consisting of historical information, geographical information, cultural information, and information relating to tourist facilities.

6. The method of claim 2, wherein the database has a data structure, and wherein the method further comprises the step of arranging the data structure according to the position determined in step (a).

7. The method of claim 2, wherein the retrieving step is preceded by the step of providing inputs corresponding to subject areas desired by the traveler.

8. The method of claim 7, wherein the input providing step is selected from the group consisting of operating a control panel and operating a voice-activated unit.

* * * * *